US007757774B2

(12) United States Patent
Ring

(10) Patent No.: US 7,757,774 B2
(45) Date of Patent: Jul. 20, 2010

(54) METHOD OF COMPLETING A WELL

(75) Inventor: Lev Ring, Houston, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 313 days.

(21) Appl. No.: 11/248,736

(22) Filed: Oct. 12, 2005

(65) Prior Publication Data

US 2006/0076147 A1 Apr. 13, 2006

Related U.S. Application Data

(60) Provisional application No. 60/617,763, filed on Oct. 12, 2004.

(51) Int. Cl.
*E21B 43/10* (2006.01)
*E21B 23/02* (2006.01)

(52) U.S. Cl. ..... 166/380; 166/384

(58) Field of Classification Search ..... 166/207, 166/380, 384

See application file for complete search history.

(56) References Cited

U.S. PATENT DOCUMENTS

| | | | |
|---|---|---|---|
| 1,233,888 | A | 7/1917 | Leonard |
| 1,301,285 | A | 4/1919 | Leonard |
| 1,880,218 | A | 10/1932 | Simmons |
| 1,981,525 | A | 11/1934 | Price |
| 2,214,225 | A | 9/1940 | Drummond |
| 2,214,226 | A | 9/1940 | English |
| 2,519,116 | A | 8/1950 | Crake |
| 3,028,915 | A | 4/1962 | Jennings |
| 3,186,485 | A | 6/1965 | Owen |
| 3,203,483 | A | 8/1965 | Vincent |
| 3,245,471 | A | 4/1966 | Howard |
| 3,297,092 | A | 1/1967 | Jennings |
| 3,326,293 | A | 6/1967 | Skipper |
| 3,353,599 | A | 11/1967 | Swift |
| 3,354,955 | A | 11/1967 | Berry |
| 3,477,506 | A | 11/1969 | Malone |
| 3,489,220 | A | 1/1970 | Kinley |
| 3,498,376 | A | 3/1970 | Sizer et al. |
| 3,669,190 | A | 6/1972 | Sizer et al. |
| 3,691,624 | A | 9/1972 | Kinley |
| 3,746,091 | A | 7/1973 | Owen et al. |
| 3,776,307 | A | 12/1973 | Young |
| 3,780,562 | A | 12/1973 | Kinley |
| 3,785,193 | A | 1/1974 | Kinley et al. |
| 4,069,573 | A | 1/1978 | Rogers, Jr. et al. |

(Continued)

FOREIGN PATENT DOCUMENTS

| | | |
|---|---|---|
| GB | 2 412 394 | 9/2005 |

(Continued)

OTHER PUBLICATIONS

U.K. Search Report, Application No. GB0520692.5, dated Nov. 22, 2005.

*Primary Examiner*—David J Bagnell
*Assistant Examiner*—Robert E Fuller
(74) *Attorney, Agent, or Firm*—Patterson & Sheridan, LLP

(57) ABSTRACT

A method for manufacturing the expandable tubular comprises forming a plurality of corrugated portions on the expandable tubular and separating adjacent corrugated portions by an uncorrugated portion. Thereafter, the expandable tubular is reformed to an uniform outer diameter. The expandable tubular may be used to complete a wellbore.

31 Claims, 12 Drawing Sheets

U.S. PATENT DOCUMENTS

| | | | | |
|---|---|---|---|---|
| 4,159,564 | A | 7/1979 | Cooper, Jr. | |
| 4,359,889 | A | 11/1982 | Kelly | |
| 4,414,739 | A | 11/1983 | Kelly | |
| 4,450,612 | A | 5/1984 | Kelly | |
| 4,502,308 | A | 3/1985 | Kelly | |
| 4,567,631 | A | 2/1986 | Kelly | |
| 4,976,322 | A | 12/1990 | Abdrakhmanov et al. | |
| 5,014,779 | A | 5/1991 | Meling et al. | |
| 5,031,699 | A | 7/1991 | Artynov et al. | |
| 5,052,483 | A | 10/1991 | Hudson | |
| 5,083,608 | A | 1/1992 | Abdrakhmanov et al. | |
| 5,119,661 | A | 6/1992 | Abdrakhmanov et al. | |
| 5,322,127 | A | 6/1994 | McNair et al. | |
| 5,337,823 | A | 8/1994 | Nobileau | |
| 5,348,095 | A | 9/1994 | Worrall et al. | |
| 5,388,648 | A | 2/1995 | Jordan, Jr. | |
| 5,624,560 | A | 4/1997 | Voll et al. | |
| 5,667,011 | A | 9/1997 | Gill et al. | |
| 5,685,369 | A | 11/1997 | Ellis et al. | |
| 5,785,120 | A | 7/1998 | Smalley et al. | |
| 5,787,984 | A | 8/1998 | Mabile | |
| 5,957,195 | A | 9/1999 | Bailey et al. | |
| 5,979,560 | A | 11/1999 | Nobileau | |
| 6,070,671 | A | 6/2000 | Cumming et al. | |
| 6,073,692 | A | 6/2000 | Wood et al. | |
| 6,085,838 | A | 7/2000 | Vercaemer et al. | |
| 6,098,717 | A | 8/2000 | Bailey et al. | |
| 6,135,208 | A | 10/2000 | Gano et al. | |
| 6,253,852 | B1 | 7/2001 | Nobileau | |
| 6,328,113 | B1 | 12/2001 | Cook | |
| 6,354,373 | B1 | 3/2002 | Vercaemer et al. | |
| 6,409,226 | B1 | 6/2002 | Slack et al. | |
| 6,425,444 | B1 | 7/2002 | Metcalfe et al. | |
| 6,446,724 | B2 | 9/2002 | Baugh et al. | |
| 6,457,518 | B1 | 10/2002 | Castano-Mears et al. | |
| 6,457,532 | B1 | 10/2002 | Simpson | |
| 6,470,966 | B2 | 10/2002 | Cook et al. | |
| 6,513,588 | B1 | 2/2003 | Metcalfe | |
| 6,543,552 | B1 | 4/2003 | Metcalfe et al. | |
| 6,571,871 | B2 | 6/2003 | Lauritzen et al. | |
| 6,578,630 | B2 | 6/2003 | Simpson et al. | |
| 6,629,567 | B2 * | 10/2003 | Lauritzen et al. | 166/380 |
| 6,708,767 | B2 | 3/2004 | Harrall et al. | |
| 6,712,151 | B2 | 3/2004 | Simpson et al. | |
| 6,742,598 | B2 | 6/2004 | Whitelaw et al. | |
| 6,799,632 | B2 * | 10/2004 | Hall et al. | 166/207 |
| 6,815,946 | B2 * | 11/2004 | Yoo | 324/221 |
| 6,868,905 | B2 | 3/2005 | Lauritzen et al. | |
| 6,923,035 | B2 | 8/2005 | Zifferer et al. | |
| 6,976,536 | B2 | 12/2005 | Simpson et al. | |
| 7,017,670 | B2 | 3/2006 | Hazel et al. | |
| 7,028,780 | B2 | 4/2006 | Maguire | |
| 7,063,149 | B2 | 6/2006 | Simpson et al. | |
| 7,086,480 | B2 | 8/2006 | Simpson et al. | |
| 7,090,024 | B2 | 8/2006 | Simpson et al. | |
| 7,090,025 | B2 | 8/2006 | Haugen et al. | |
| 7,104,322 | B2 | 9/2006 | Whanger et al. | |
| 7,121,351 | B2 | 10/2006 | Luke et al. | |
| 7,144,243 | B2 | 12/2006 | Stephenson et al. | |
| 7,152,679 | B2 | 12/2006 | Simpson | |
| 7,204,306 | B2 | 4/2007 | Abdrakhmanov et al. | |
| 7,350,584 | B2 | 4/2008 | Simpson et al. | |
| 7,350,585 | B2 | 4/2008 | Simpson et al. | |
| 2003/0037931 | A1 | 2/2003 | Coon | |
| 2003/0205386 | A1 | 11/2003 | Johnston et al. | |
| 2003/0230410 | A1 * | 12/2003 | Underhill | 166/381 |
| 2004/0020659 | A1 | 2/2004 | Hall et al. | |
| 2004/0055758 | A1 * | 3/2004 | Brezinski et al. | 166/384 |
| 2004/0079528 | A1 | 4/2004 | Metcalfe et al. | |
| 2004/0140103 | A1 | 7/2004 | Steele et al. | |
| 2004/0159446 | A1 | 8/2004 | Haugen et al. | |
| 2004/0173360 | A1 | 9/2004 | Harrall et al. | |
| 2005/0000697 | A1 | 1/2005 | Abercrombie Simpson et al. | |
| 2005/0082092 | A1 | 4/2005 | Hall et al. | |
| 2005/0098324 | A1 * | 5/2005 | Gano | 166/384 |
| 2005/0217865 | A1 | 10/2005 | Ring | |
| 2005/0269107 | A1 | 12/2005 | Cook et al. | |
| 2006/0076147 | A1 | 4/2006 | Ring | |
| 2006/0231250 | A1 | 10/2006 | Slack | |

FOREIGN PATENT DOCUMENTS

| | | |
|---|---|---|
| RU | 1786241 | 1/1993 |
| RU | 2001257 | 1/1993 |
| RU | 1070989 | 8/1994 |
| RU | 1239363 | 11/1994 |
| RU | 2064357 | 7/1996 |
| RU | 963333 | 11/1996 |
| RU | 1367586 | 11/1996 |
| RU | 2 079 633 | 5/1997 |
| RU | 2 083 798 | 7/1997 |
| RU | 2142349 | 1/1998 |
| SU | 1041671 | 9/1983 |
| SU | 1813171 | 7/1991 |
| SU | 1745873 | 7/1992 |
| WO | WO 98/00626 | 1/1998 |
| WO | WO 99/35368 | 7/1999 |
| WO | WO 00/61914 | 10/2000 |
| WO | WO 02/31312 | 4/2002 |
| WO | WO 2005/003476 | 1/2005 |

* cited by examiner

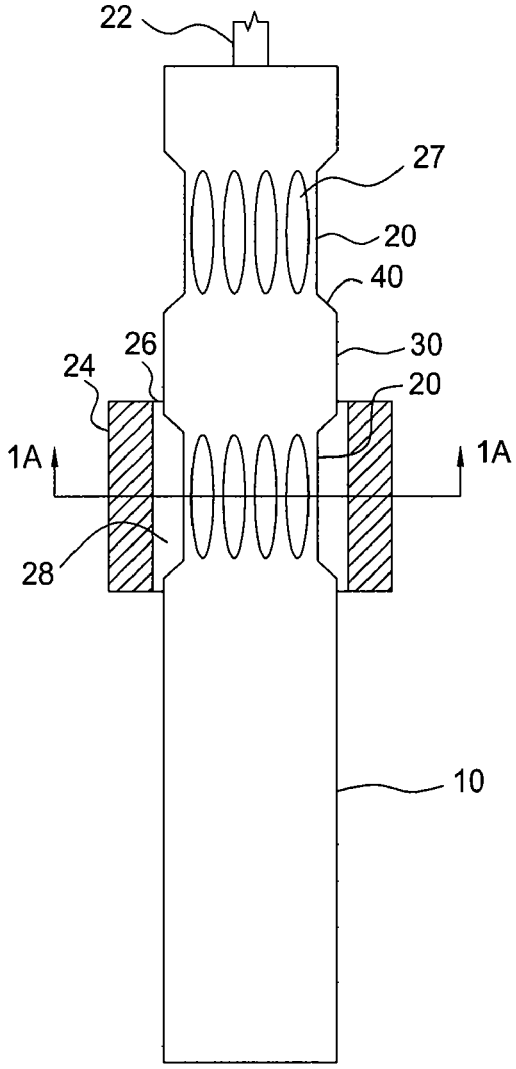
FIG. 1
FIG. 1A
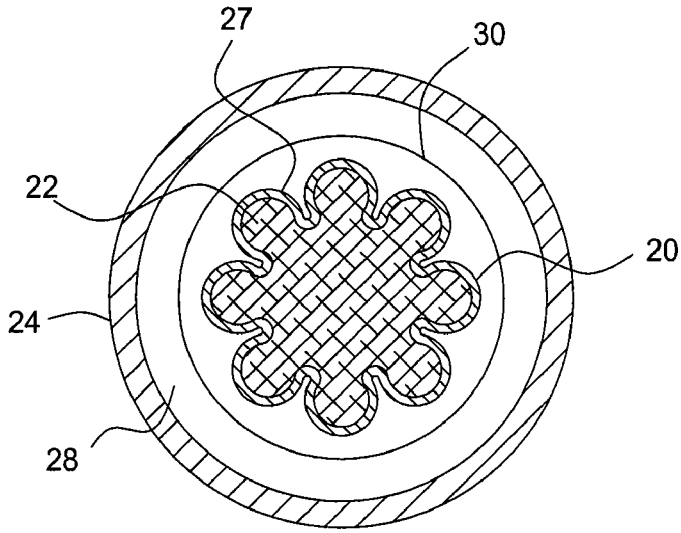

METHOD OF COMPLETING A WELL

CROSS-REFERENCE TO RELATED APPLICATIONS

This application claims benefit of U.S. Provisional Patent Application Ser. No. 60/617,763, filed on Oct. 12, 2004, which application is herein incorporated by reference in its entirety.

BACKGROUND OF THE INVENTION

1. Field of the Invention

Embodiments of the present invention generally relate to methods and apparatus for manufacturing an expandable tubular. Particularly, the present invention relates to methods and apparatus for manufacturing a corrugated expandable tubular. Embodiments of the present invention also relate to methods and apparatus for expanding an expandable tubular.

2. Description of the Related Art

In the oil and gas exploration and production industry, boreholes are drilled through rock formations to gain access to hydrocarbon-bearing formations, to allow the hydrocarbons to be recovered to surface. During drilling of a typical borehole, which may be several thousand feet in length, many different rock formations are encountered.

Rock formations having problematic physical characteristics, such as high permeability, may be encountered during the drilling operation. These formations may cause various problems such as allowing unwanted water or gases to enter the borehole; crossflow between high and low pressure zones; and fluid communication between a highly permeable formation and adjacent formations. In instances where a sub-normal or over-pressured formation is sealed off, the permeability of the formation may be such that high pressure fluids permeate upwardly or downwardly, thereby re-entering the borehole at a different location.

Damage to rock formations during drilling of a borehole may also cause problems for the drilling operation. Damage to the formation may be caused by the pressurized drilling fluid used in the drilling operation. In these situations, drilling fluid may be lost into the formation. Loss of drilling fluid may cause the drilling operation to be halted in order to take remedial action to stabilize the rock formation. Loss of drilling fluid is undesirable because drilling fluids are typically expensive. In many cases, drilling fluids are re-circulated and cleaned for use in subsequent drilling procedures in order to save costs. Therefore, loss of high quantities of drilling fluid is unacceptable.

One method of overcoming these problems involves lining the borehole with a casing. This generally requires suspending the casing from the wellhead and cementing the casing in place, thereby sealing off and isolating the damaged formation. However, running and cementing additional casing strings is a time-consuming and expensive operation.

Furthermore, due to the installation of the casing, the borehole drilled below the casing has a smaller diameter than the sections above it. As the borehole continues to be extended and casing strings added, the inner diameter of the borehole continues to decrease. Because drilling operations are carefully planned, problematic formations unexpectedly encountered may cause the inner diameter of the borehole to be overly restricted when additional casing strings are installed. Although this may be accounted for during planning, it is generally undesired and several such occurrences may cause a reduction in final bore diameter, thereby affecting the future production of hydrocarbons from the well.

More recently, expandable tubular technology has been developed to install casing strings without significantly decreasing the inner diameter of the wellbore. Generally, expandable technology enables a smaller diameter tubular to pass through a larger diameter tubular, and thereafter be expanded to a larger diameter. In this respect, expandable technology permits the formation of a tubular string having a substantially constant inner diameter, otherwise known as a monobore. Accordingly, monobore wells have a substantially uniform through-bore from the surface casing to the production zones.

A monobore well features each progressive borehole section being cased without a reduction of casing size. The monobore well offers the advantage of being able to start with a much smaller surface casing but still end up with a desired size of production casing. Further, the monobore well provides a more economical and efficient way of completing a well. Because top-hole sizes are reduced, less drilling fluid is required and fewer cuttings are created for cleanup and disposal. Also, a smaller surface casing size simplifies the wellhead design as well as the blow out protectors and risers. Additionally, running expandable liners instead of long casing strings will result in valuable time savings.

There are certain disadvantages associated with expandable tubular technology. One disadvantage relates to the elastic limits of a tubular. For many tubulars, expansion past about 22-25% of their original diameter may cause the tubular to fracture due to stress. However, securing the liner in the borehole by expansion alone generally requires an increase in diameter of over 25%. Therefore, the cementation operation must be employed to fill in the annular area between the expanded tubular and the borehole.

One attempt to increase expandability of a tubular is using corrugated tubulars. It is known to use tubulars which have a long corrugated portion. After reforming the corrugated portion, a fixed diameter expander tool is used to insure a minimum inner diameter after expansion. However, due the long length of corrugation and the unevenness of the reformation, a problem arises with the stability of the expander tool during expansion. For example, the reformed tubular may be expanded using a roller expander tool. During expansion, only one roller is typically in contact with the tubular as the expander tool is rotated. As a result, the expander tool may wobble during expansion, thereby resulting in poor expansion of the tubular.

There is, therefore, a need for a method and an apparatus for manufacturing a tubular which may be expanded sufficiently to line a wellbore. There is also a need for a method and apparatus for expanding the diameter of a tubular sufficiently to line a wellbore. There is a further need for methods and apparatus for stabilizing the expander tool during expansion. There is a further need for methods and apparatus for expanding the reformed tubular using a compliant expander tool.

SUMMARY OF THE INVENTION

Embodiments of the present invention generally provide apparatus and methods for manufacturing an expandable tubular. In one embodiment, the method for manufacturing the expandable tubular comprises forming a plurality of corrugated portions on the expandable tubular and separating adjacent corrugated portions by an uncorrugated portion. In another embodiment, the method also includes reforming the expandable tubular to an uniform outer diameter. In yet another embodiment, the method further includes heat treating the expandable tubular.

In yet another embodiment, an expandable tubular comprises a unitary structure having a plurality of corrugated portions, wherein adjacent corrugated portions are separated by an uncorrugated portion.

In yet another embodiment, a method of completing a well includes forming an expandable tubular by forming a first corrugated portion and forming a second corrugated portion, wherein the first and second corrugated portions are separated by an uncorrugated portion. Thereafter, the method includes reforming the first and second corrugated portions to a diameter greater than the uncorrugated portion and optionally expanding the uncorrugated portion. In the preferred embodiment, the first and second corrugated portions are formed using a hydroforming process.

In yet another embodiment, a method of completing a well includes providing a tubular having a plurality of corrugated portions separated by an uncorrugated portion; selectively reforming the plurality of corrugated portions using fluid pressure; and expanding the uncorrugated portion using mechanical force. In another embodiment, the method further comprises forming an aperture in the uncorrugated portion. In yet another embodiment, the method further includes surrounding the aperture with a filter medium. In yet another embodiment, the method further includes isolating a zone of interest. In yet another embodiment, the method further includes collecting fluid from the zone of interest through the aperture.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

FIG. 1 is a perspective view of a partially formed expandable tubular.

FIG. 1A is a cross-sectional view of the expandable tubular of FIG. 1.

DETAILED DESCRIPTION OF THE PREFERRED EMBODIMENT

Figure 1B:
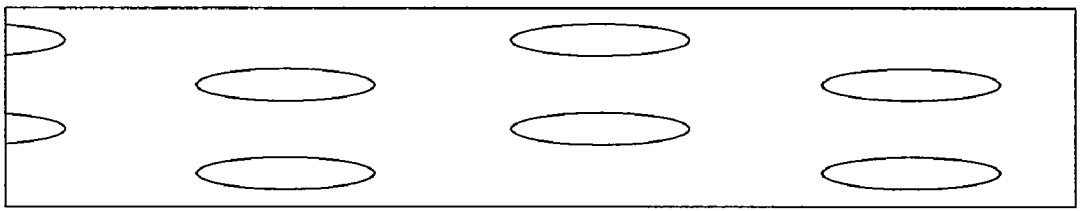
FIGS. 1B-1D shows different embodiments of corrugated portions.

FIG. 1 shows an expandable tubular manufactured according to one embodiment of the present invention. As shown, the tubular 10 is a solid expandable tubular having corrugated 20 and non-corrugated sections 30. The corrugated sections 20 define a folded wall section having a folded diameter that is smaller than the original diameter of the tubular 10. Preferably, corrugated and non-corrugated sections 20, 30 alternate along the length of the tubular 10.

In one embodiment, the corrugated sections 20 are created using a hydroforming process. Generally, a hydroforming process utilizes fluid pressure to cause the tubular 10 to deform, thereby creating the corrugated or crinkled section. As shown, the corrugated section 20 may be formed using an internal mandrel 22 and an outer sleeve 24. The internal mandrel 22 is adapted to provide the desired profile of the corrugated section 20. The external sleeve 24 is dispose around the exterior of the tubular 10 to exert pressure on the tubular 10 against the internal mandrel 22.

During operation, the internal mandrel 22 having the desired profile is inserted into the tubular 10 and positioned adjacent the portion of the tubular 10 to be corrugated. The outer sleeve 24 is then position around the exterior of the same portion of the tubular 10. One or more seals 26 are provided between the external sleeve 24 and the tubular 10 such that a fluid chamber 28 is formed therebetween. Thereafter, high pressure fluid is introduced through the outer sleeve 24 into the fluid chamber 28 to plastically deform the tubular 10. The pressure fluid causes the tubular 10 to conform against profile of the internal mandrel 22, thereby forming the desired corrugated pattern. After the corrugated section 20 is formed, fluid pressure is relieved, and the internal mandrel 22 and the external sleeve 24 are moved to the next section of the tubular 10. In this manner, one or more corrugated sections 20 may be formed between non-corrugated sections 30 of the tubular 10. In another embodiment, the internal mandrel may supply the pressure to deform the tubular against the internal profile of the external sleeve, thereby forming the corrugated section of the tubular. It must be noted that other types of deforming process known to a person of ordinary skill in the art are also contemplated.

Figure 1C:
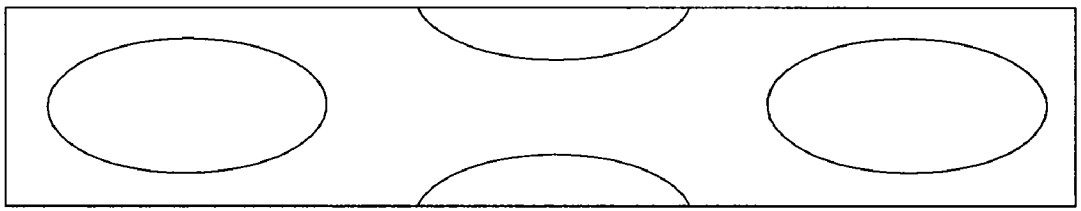
Figure 1D:
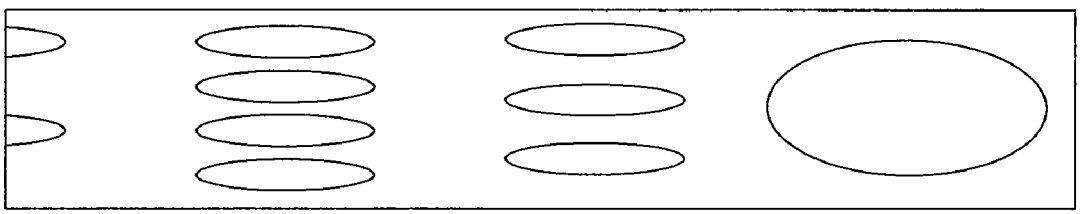

The profile or shape of the corrugated section 20 includes folds or grooves 27 formed circumferentially around the tubular 10. FIG. 1A is a cross-sectional view of the tubular 10 along line 1A-1A. It can be seen that the tubular wall has conformed to the profile of the internal mandrel 22, thereby forming the corrugations. Additionally, the hydroforming process has caused the diameter of the corrugated section 20 to decrease in comparison to the diameter of the non-corrugated section 30. The profile or shape of the corrugated section 20 and the extent of corrugation are not limited to the embodiment shown in FIG. 1. For example, the profile may have one or more folds; may be symmetric or asymmetric; and may be combinations thereof. Furthermore, as shown, the grooves or folds 27 between adjacent corrugated sections 20 are aligned or in-phase. Alternatively, the profile may be rotated so that the folds or grooves between adjacent corrugated sections are not aligned or out-of-phase, as shown in FIGS. 1B and 1C. Alternatively, the length of the folds may vary among the corrugated sections 20, as shown in FIG. 1D. In another embodiment, the number folds may vary for each corrugation portion 20, which is also shown in FIG. 1D. The corrugated section 20 may take on any profile so long as the stress from the corrugation does not cause fracture of the tubular 10 upon reformation.

Figure 2:
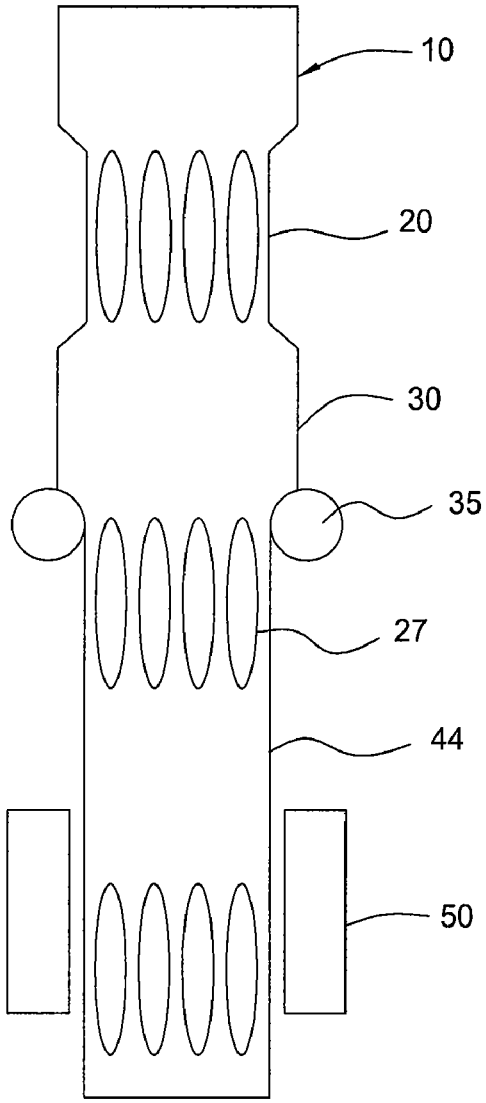
FIG. 2 is a perspective view of the expandable tubular of FIG. 1 during the manufacturing process.

In another embodiment, the tubular 10 having the corrugated and non-corrugated sections 20, 30 may be optionally reformed to a consistent outer diameter 44, as shown in FIG. 2. In FIG. 2, the tubular 10 is drawn through a pair of dies 35 adapted to reduce the overall diameter of the tubular 10. Preferably, the overall diameter of the tubular 10 is decreased to the size of the corrugated section 20. Any suitable process for drawing down the diameter of the tubular known to a person of ordinary skill in the art may be used.

In the preferred embodiment, after the tubular diameter has been reduced, the tubular 10 is optionally heat treated to reduce the stress on the tubular 10 caused by work hardening. The heat treatment 50 allows the tubular 10 to have sufficient ductility to undergo further cold working without fracturing. Any suitable heat treatment process known to a person of ordinary skill in the art may be used, for example, process annealing.

Figure 3:
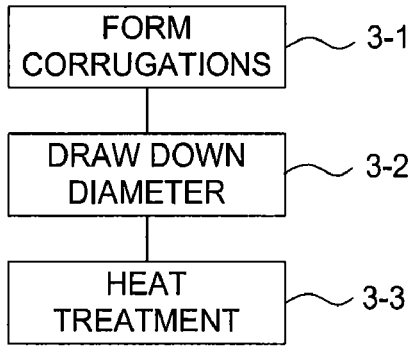
FIG. 3 is a flow diagram of one embodiment of manufacturing an expandable tubular.

FIG. 3 is a flow diagram of the preferred embodiment of manufacturing a corrugated expandable tubular. In step 3-1, corrugated sections are formed on the tubular using a hydroforming process. In step 3-2, the overall diameter of the tubular is reduced. In step 3-3, the tubular is heat treated.

In one embodiment, the expandable tubular may comprise unitary structure. An exemplary unitary structure is a single joint of tubular. Multiple joints of expandable tubular may be connected to form a string of expandable tubular. In another embodiment, the unitary structure may comprise a continuous length of expandable tubular that can be stored on a reel. In operation, the corrugated portions may be formed on the expandable tubular as it unwinds from the reel. Additionally, the free end of the expandable tubular having the corrugated portions may be wound onto another reel.

Figure 4A:
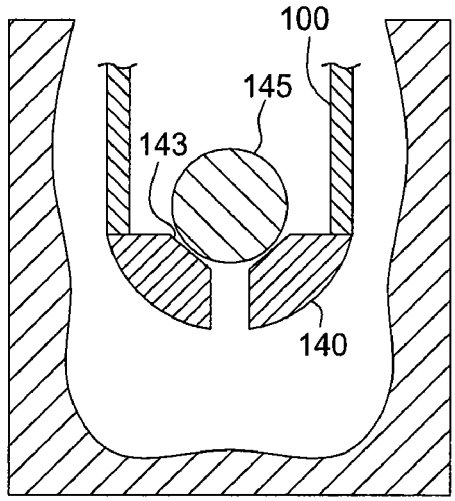
FIG. 4 is a perspective of a corrugated expandable tubular disposed in a wellbore.
Figures 4, 5, 7:
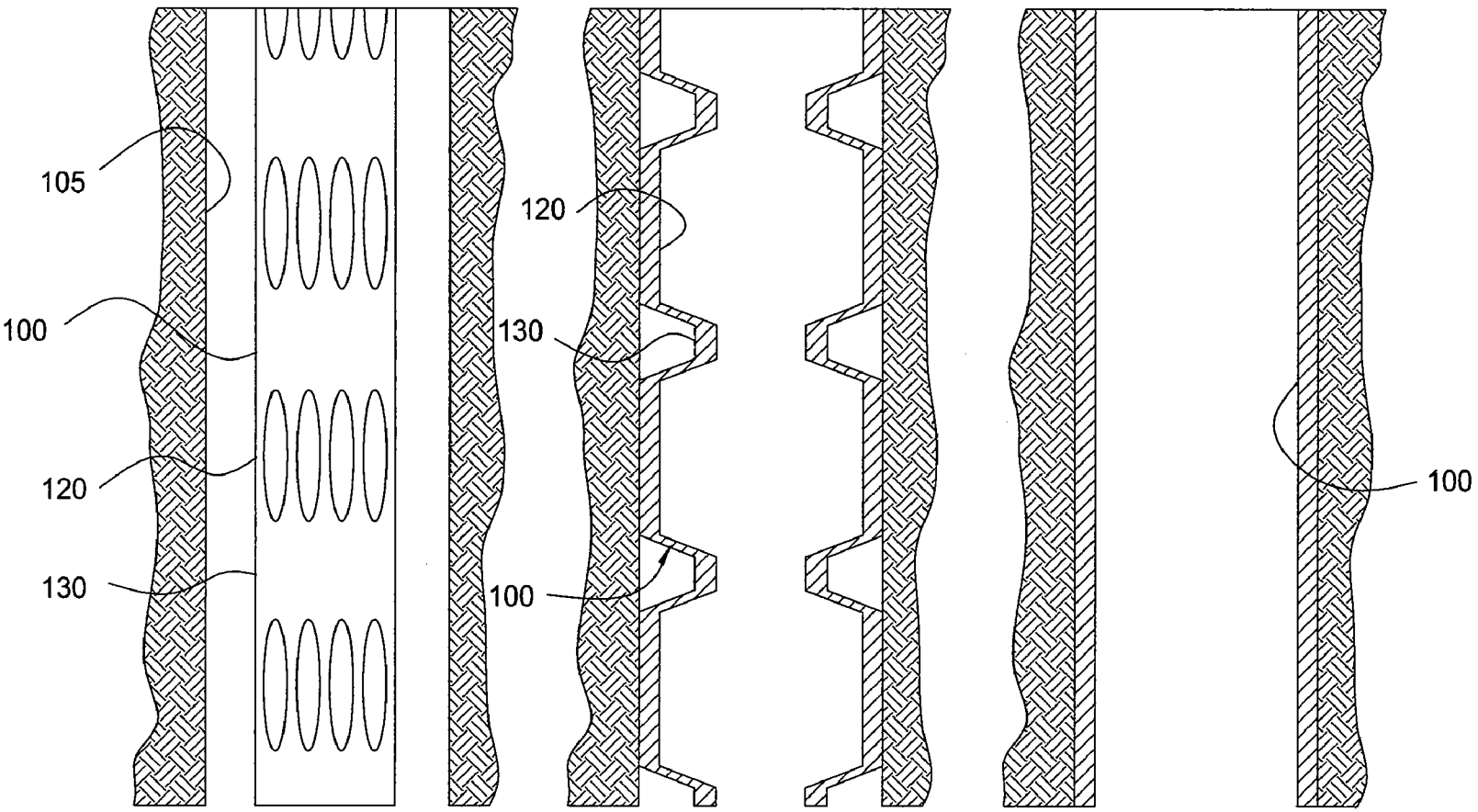
FIG. 5 is a perspective of the corrugated expandable tubular of FIG. 4 after hydraulic reform.
FIG. 7 is a perspective view of the expandable tubular after expansion.

FIG. 4 shows a corrugated tubular 100 disposed in a wellbore 105. The expandable tubular 100 is particularly useful in sealing a highly permeable section of the wellbore. The tubular 100 may be run in using a working string connected to the tubular 100. The tubular 100 may include a shoe disposed at a lower portion and a seal disposed at an upper portion between the tubular and the work string. The shoe 140 includes a seat 143 for receiving a hydraulic isolation device 145 such as a ball or a dart, as shown in FIG. 4A. The seal is preferably fabricated from a pliable material to provide a fluid tight seal between working string and the tubular 100.

To reform the tubular 100, a ball is dropped into the work string and lands in the seat of the shoe, thereby closing off the shoe for fluid communication. Thereafter, pressurized fluid is introduced into the tubular 100 to increase the pressure inside the tubular 100. As pressure builds inside the tubular 100, the corrugated section 120 begins to reform or unfold from the folded diameter. FIG. 5 shows the tubular 100 after it has been hydraulically reformed. Although the corrugated section 120 has reformed, it can be seen that the uncorrugated sections 130 are substantially unchanged. However, it must be noted that, in some cases, the uncorrugated sections 130 may undergo some reformation or expansion due to the fluid pressure.

Figure 6:
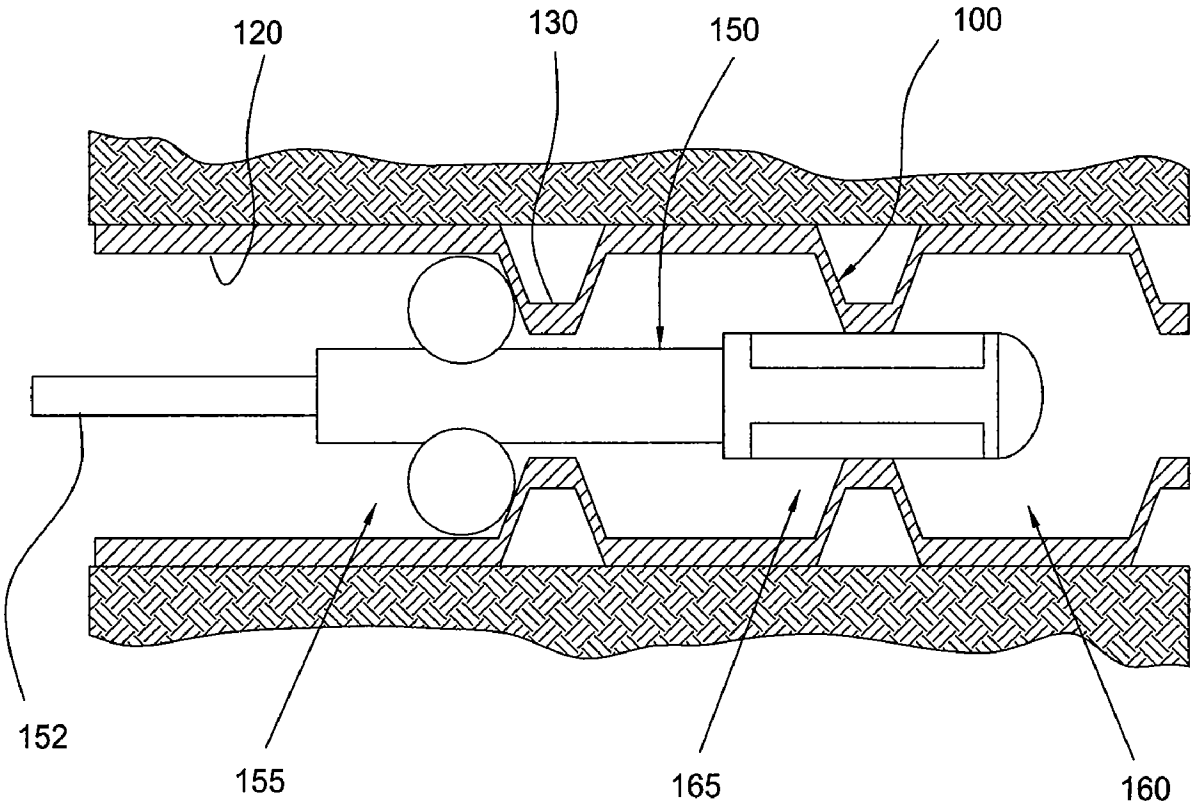
FIG. 6 is a schematic view of an expander tool for expanding the corrugated expandable tubular.

After hydraulic reformation, an expansion tool 150 may be used to expand the uncorrugated sections 130, or upset portions shown in FIG. 6, and the reformed corrugated portions. FIG. 6 is a schematic drawing of an embodiment of the expansion tool 150. As shown, the expansion tool 150 includes an expander member 155 and a guide 160. Preferably, the guide 160 has an outer diameter that is about the same size as the inner diameter of the upset portions. Also, the guide 160 is adapted to contact at least one upset portion of the tubular 100 during expansion. As shown in FIG. 6, the guide 160 is in contact with the upset portion that is adjacent to the upset portion to be expanded. In this respect, the guide 160 may interact with the upset portion to provide centralization and stabilization for the expansion tool 150 during the expansion process. In this manner, the tubular 100 may be expanded to provide a substantially uniform inner diameter, as shown in FIG. 7.

It is contemplated that any suitable expander member known to a person of ordinary skill in the art may be used to perform the expansion process. Suitable expander members are disclosed in U.S. Pat. No. 6,457,532; U.S. Pat. No. 6,708,767; U.S. Patent Application Publication No. 2003/0127774; U.S. Patent Application Publication No. 2004/0159446; U.S. Patent Application Publication No. 2004/0149450; International Application No. PCT/GB02/05387; and U.S. patent application Ser. No. 10/808,249, filed on Mar. 24, 2004, which patents and applications are herein incorporated by reference in their entirety. Suitable expander members include compliant and non-compliant expander members and rotary and non-rotary expander members. Exemplary expander members include roller type and cone type expanders, any of which may be compliant or non-compliant.

Figure 8:
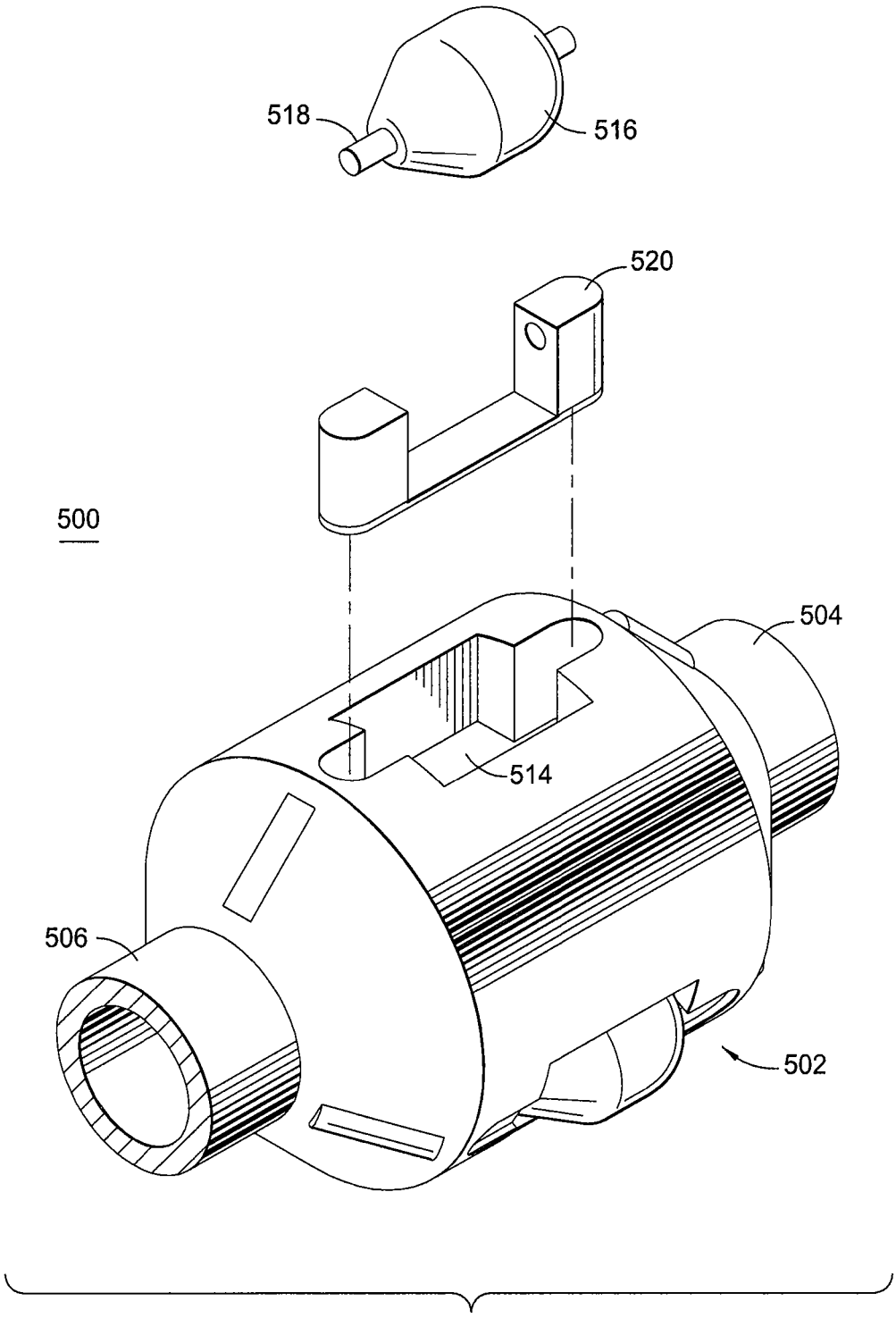
FIG. 8 is a perspective view of an expander member suitable for performing the expansion process.

In one embodiment, shown in FIG. 8, a rotary expander member 500 includes a body 502, which is hollow and generally tubular with connectors 504 and 506 for connection to other components (not shown) of a downhole assembly. The connectors 504 and 506 are of a reduced diameter compared to the outside diameter of the longitudinally central body part of the tool 500. The central body part 502 of the expander tool 500 shown in FIG. 8 has three recesses 514, each holding a respective roller 516. Each of the recesses 514 has parallel sides and extends radially from a radially perforated tubular core (not shown) of the tool 500. Each of the mutually identical rollers 516 is somewhat cylindrical and barreled. Each of the rollers 516 is mounted by means of an axle 518 at each end of the respective roller 516 and the axles are mounted in slidable pistons 520. The rollers 516 are arranged for rotation about a respective rotational axis that is parallel to the longitudinal axis of the tool 500 and radially offset therefrom at 120-degree mutual circumferential separations around the central body 502. The axles 518 are formed as integral end members of the rollers 516, with the pistons 520 being radially slidable, one piston 520 being slidably sealed within each radially extended recess 514. The inner end of each piston 520 is exposed to the pressure of fluid within the hollow core of the tool 500 by way of the radial perforations in the tubular core. In this manner, pressurized fluid provided from the surface of the well, via a working string 152, can actuate the pistons 520 and cause them to extend outward whereby the rollers 516 contact the inner wall of the tubular 100 to be expanded.

In some instances, it may be difficult to rotate the guide 150 against the upset portion. As a result, the expander member 155 may experience drag during rotation. In one embodiment, the guide 160 may be equipped with a swivel 165 to facilitate operation of the expander member 155. As shown, the swivel 165 comprises a tubular sleeve for contacting the upset portion. In this respect, the expander member 155 is allowed to rotate freely relative to the tubular sleeve, while the tubular sleeve absorbs any frictional forces from the upset portions. In another embodiment, the swivel may be used to couple the expander member and the guide. In this respect, the guide and the expander member may rotate independently of each other during operation.

In another embodiment, a seal coating may be applied to one or more outer portions of the expandable tubular. The seal coating ensures that a fluid tight seal is formed between the expandable tubular and the wellbore. The seal coating also guards against fluid leaks that may arise when the expandable tubular is unevenly or incompletely expanded. In the preferred embodiment, the seal coating is applied to an outer portion of the corrugated portion. Exemplary materials for the seal coating include elastomers, rubber, epoxy, polymers, and any other suitable seal material known to a person of ordinary skill in the art.

Figure 9:
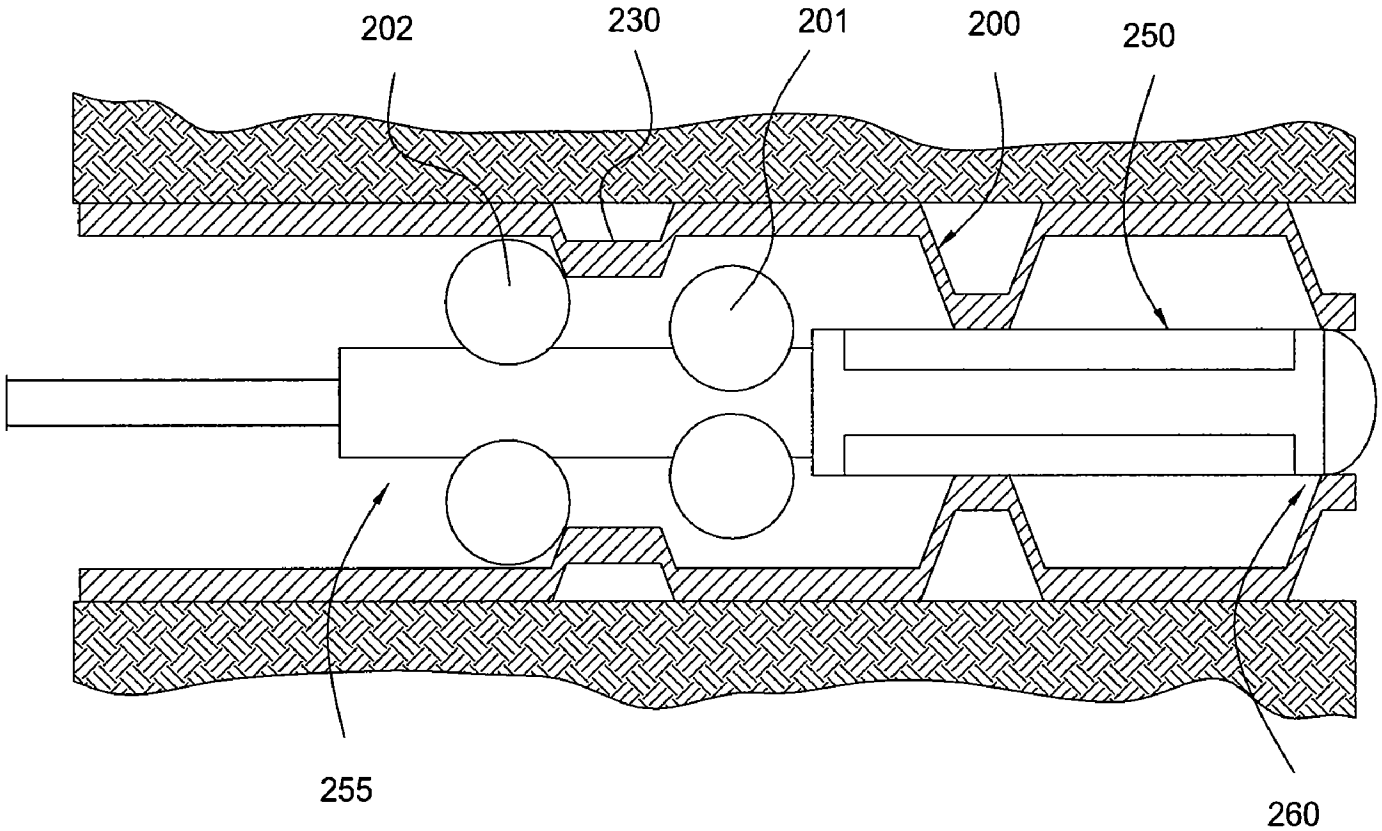
FIG. 9 is a schematic view of another expander tool for expanding the corrugated expandable tubular.

FIG. 9 shows another embodiment of the expander tool 250. In this embodiment, the expander tool 250 is adapted to perform a multi-stage expansion process. The expander tool 250 is configured with two sets of rollers 201, 202 for expanding the upset portions 230 incrementally. As shown, the first set of rollers 201 has partially expanded the upset portion 230, and the second set of rollers 202 is ready to expand the remaining upset portion 230. Preferably, the two sets of rollers 201, 202 are positioned sufficiently apart so that only one set of rollers are engaged with the tubular 200 at any time. In this respect, the torque required to operate the rollers 201, 202 may be minimized. In another embodiment, the expander tool 250 is provided with a guide 260 adapted to engage one or more upset portions. A guide 260 that spans two upset portions may provide additional stability to the expander member 255 during operation.

Figure 10B:
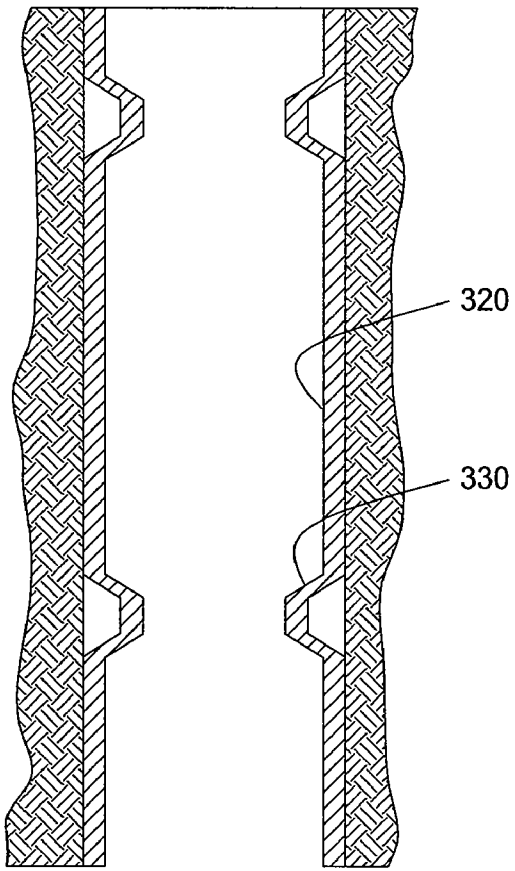
FIGS. 10A and 10B illustrate an expanded tubular having only a portion of its uncorrugated portions expanded.
Figure 10A:
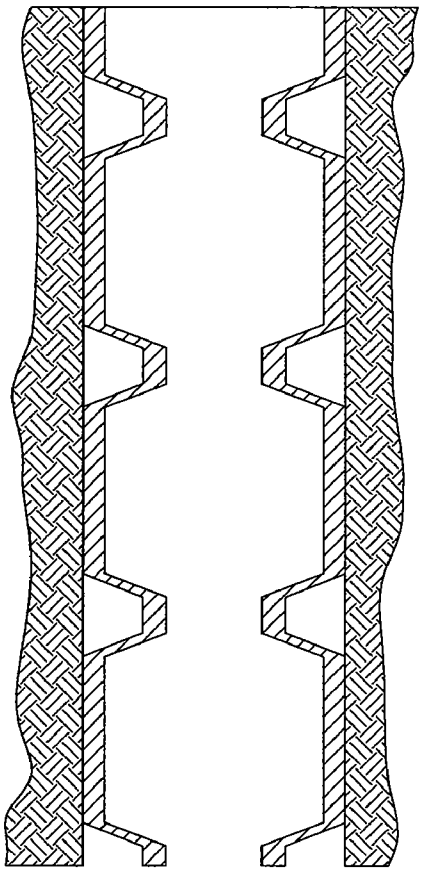

FIG. 10A shows the tubular after it has been hydraulically reformed. In this embodiment, the non-corrugated portions 330 may be partially expanded, as shown in FIG. 10B. In FIG. 10B, some of the uncorrugated portions 330 remain unexpanded. Alternatively, the uncorrugated portions 330 may be expanded such that the inner diameter is partially increased but still less than the inner diameter of the reformed corrugated portions 320.

Figure 12:
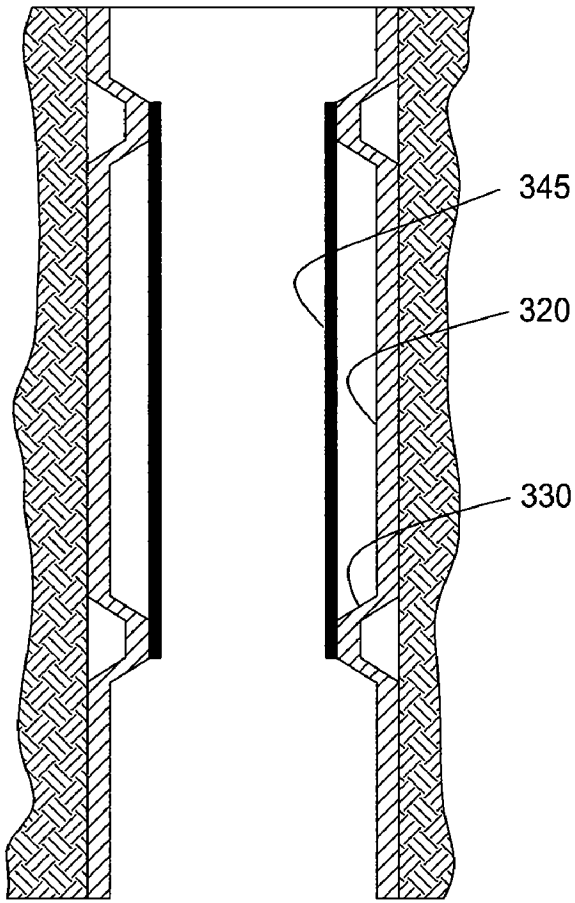
FIG. 12 illustrates another application of the expanded tubular of FIG. 10.
Figure 11:
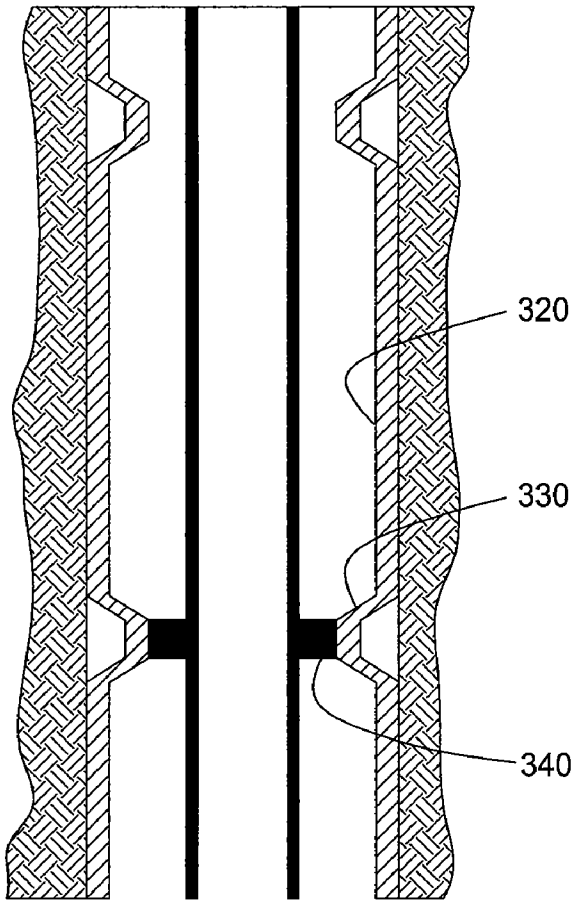
FIG. 11 illustrates an application of the expanded tubular of FIG. 10.

In one embodiment, the unexpanded or partially expanded uncorrugated portions 330 may provide a locating point for a downhole tool 340, as illustrated in FIG. 11. Exemplary downhole tools include a packer, a seal, or any downhole tool requiring a point of attachment. In another embodiment, the unexpanded or partially expanded uncorrugated portions 330 may be used to install a casing patch 345, as illustrated in FIG. 12. The casing patch 345 may be installed to seal off any leaks in the casing 320.

Figure 13:
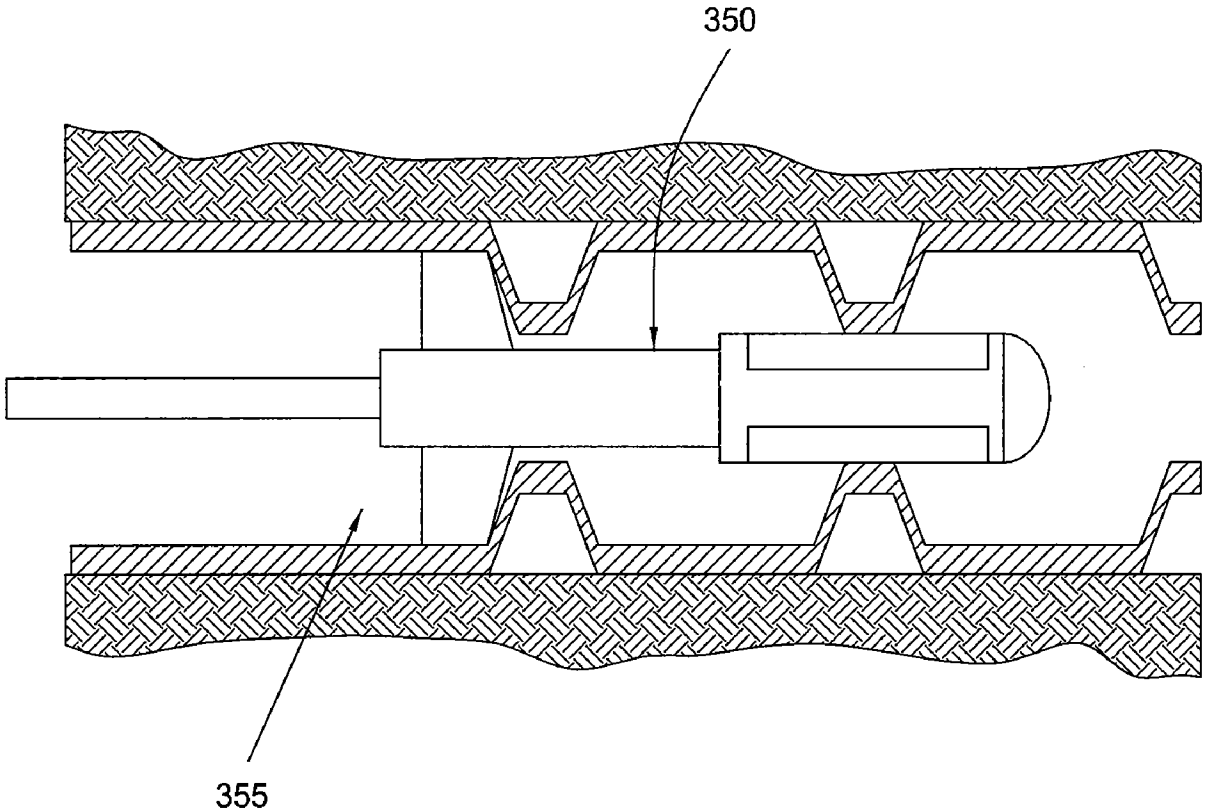
FIG. 13 is a schematic view of another expander tool for expanding the expandable tubular.
Figure 14:
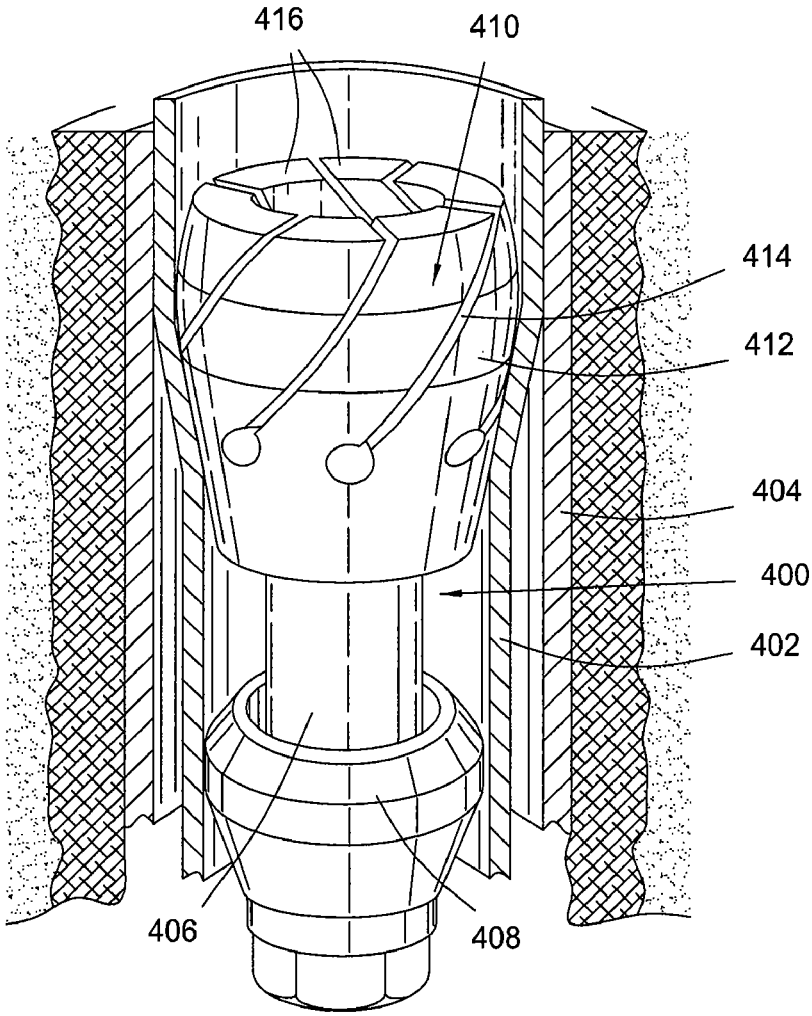
FIG. 14 is an embodiment of a compliant cone type expander.

FIG. 13 shows another embodiment of an expansion tool 350. In this embodiment, the expander member 355 comprises a cone type expander. The cone type expander may be a fixed or expandable expansion cone. In another embodiment, the cone type expander may be a compliant or non-compliant cone. A suitable compliant expansion cone is disclosed in U.S. Patent Application Publication No. 2003/0127774. An exemplary compliant cone type expander is illustrated in FIG. 14. In FIG. 14, the expander 400 is illustrated located within a section of liner 402 which the expander 400 is being used to expand, the illustrated section of liner 402 being located within a section of cemented casing 404.

As shown, the expander 400 features a central mandrel 406 carrying a leading sealing member in the form of a swab cup 408, and an expansion cone 410. The swab cup 408 is dimensioned to provide a sliding sealing contact with the inner surface of the liner 402, such that elevated fluid pressure above the swab cup 408 tends to move the expander 400 axially through the liner 402. Furthermore, the elevated fluid pressure also assists in the expansion of the liner 402, in combination with the mechanical expansion provided by the contact between the cone 410 and the liner 402.

The cone 410 is dimensioned and shaped to provide a diametric expansion of the liner 402 to a predetermined larger diameter as the cone 410 is forced through the liner 402. However, in contrast to conventional fixed diameter expansion cones, the cone 410 is at least semi-compliant, that is the cone 410 may be deformed or deflected to describe a slightly smaller diameter, or a non-circular form, in the event that the cone 410 encounters a restriction which prevents expansion of the liner 402 to the desired larger diameter cylindrical form. This is achieved by providing the cone 410 with a hollow annular body 412, and cutting the body 412 with angled slots 414 to define a number, in this example six, deflectable expansion members or fingers 416. Of course the fingers 416 are relatively stiff, to ensure a predictable degree of expansion, but may be deflected radially inwardly on encountering an immovable obstruction.

The slots 414 may be filled with a deformable material, typically an elastomer, or may be left free of material.

Figure 15:
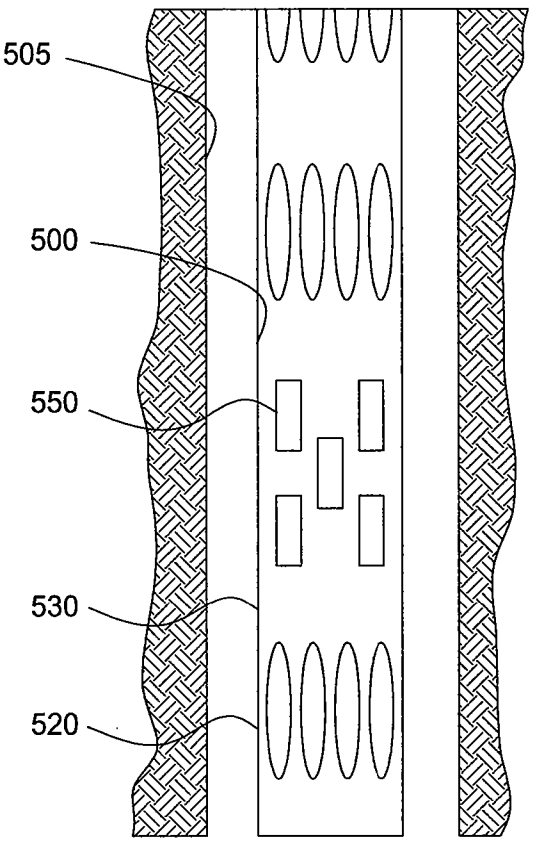

In another embodiment, the expandable tubular 500 may be used to isolate one or more zones in the wellbore 505. FIG. 15 shows an expandable tubular 500 having corrugated portions 520 and uncorrugated portions 530 disposed in the wellbore 505. Additionally, one or more apertures may be formed in the uncorrugated portion 530 of the expandable tubular 500 for fluid communication with the wellbore. The apertures allow formation fluids to flow into expandable tubular 500 for transport to the surface. As shown in FIG. 15, slots 550 are formed on the uncorrugated portion 530. The slots 550 may be sized to filter out unwanted material. Further, the slots 550 may be surrounded by a filter medium such as a screen or a mesh. Further, the slots 550 may be surrounded by a shroud to protect the filter medium. In this respect, the expandable tubular is adapted to regulated the flow of material therethrough. An exemplary shroud is an outer sleeve having one or more apertures. Another suitable shroud may comprise an outer sleeve adapted to divert the fluid flow such that the fluid does not directly impinge on the filter material. Although a slot is shown, it is contemplated that other types of apertures, such as holes or perforations, may be formed on the expandable tubular.

Figure 17:
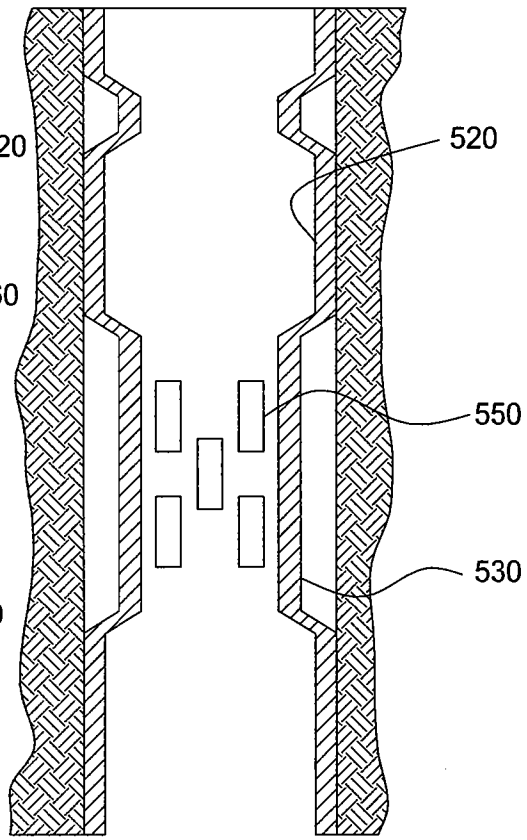
FIGS. 15-17 show an embodiment of the expandable tubular for isolating a zone of interest.
Figure 16:
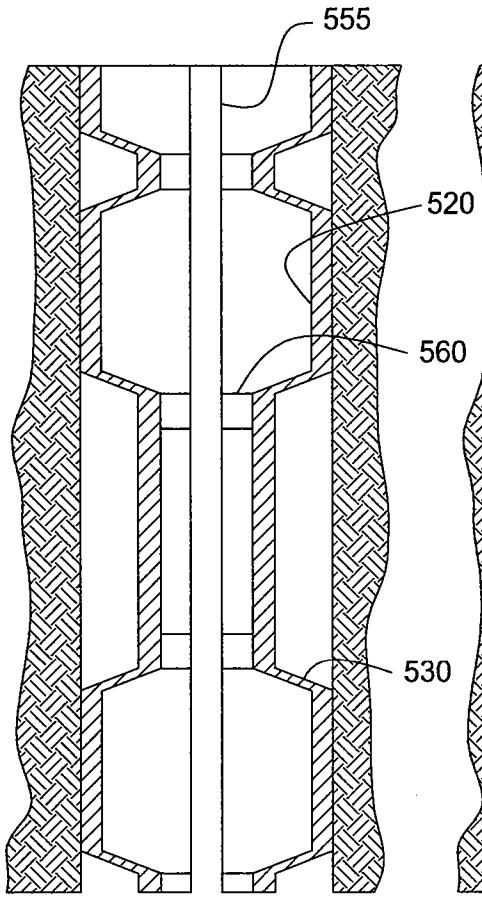

In operation, the expandable tubular 500 is manufactured by forming one or more slots 550 on the uncorrugated portions 530 of the expandable tubular 500, as shown in FIG. 15. The outer surface of the corrugated portions 520 may include a seal to insure a fluid tight seal between the corrugated portions 520 and the wellbore 505. Seals suitable for such use include elastomers, rubber, epoxy, polymers. The expandable tubular 500 is positioned in the wellbore 505 such that slots 550 are adjacent a zone of interest in the wellbore 505. Further, two corrugated portions 520 are positioned to isolate the zone of interest upon reformation. In the preferred embodiment, a hydraulic conduit 555 having one or more outer seals 560 is lowered into the wellbore 505 along with the expandable tubular 550, as shown in FIG. 16. The outer seals 560 are adapted and arranged to selectively hydraulically reform corrugated portions 520 of the expandable tubular 500. In FIG. 16, the outer seals 560 are positioned to hydraulically reform the corrugated portions 520 above and below the uncorrugated portion 530 containing the slots 550. Pressurized fluid is then supplied through a port to expand the corrugated portions 520 of the expandable tubular 500. The outer seals 560 keep the pressurized fluid within the corrugated portions 520, thereby building the pressure necessary to reform the corrugated portions 520. FIG. 17 shows the expandable tubular 500 after hydraulic reformation and removal of the hydraulic conduit 555. It can be seen that the reformed portions of the corrugated portion 520 sealingly contact the wellbore 505, thereby isolating a zone of interest for fluid communication with the slots 550 of the uncorrugated portion 530. In another embodiment, the uncorrugated portion 530 including the slots 550 may be expanded to increase the inner diameter of the expandable tubular 500.

While the foregoing is directed to embodiments of the present invention, other and further embodiments of the invention may be devised without departing from the basic scope thereof, and the scope thereof is determined by the claims that follow.

I claim:

1. A method of completing a well, comprising:

providing a unitary structure having a corrugated portion disposed between a first uncorrugated portion and a second uncorrugated portion;

selectively reforming the corrugated portion using fluid pressure;

expanding the first uncorrugated portion using mechanical force while contacting the second uncorrugated portion, wherein an expansion tool is used to expand the first uncorrugated portion; and stabilizing the expansion tool during expansion, wherein the expansion tool is stabilized by the second uncorrugated portion.

2. The method of claim 1, wherein the expansion tool comprises a guide for engaging the second uncorrugated portion.

3. The method of claim 2, further comprising rotating the expansion tool independent of the guide.

4. The method of claim 2, wherein the guide extends across the second uncorrugated portion and a third uncorrugated portion disposed adjacent the second uncorrugated portion, wherein a second corrugated portion is disposed between the second uncorrugated portion and the third uncorrugated portion.

5. The method of claim 1, wherein the expansion tool comprises a rotary expander member.

6. The method of claim 1, wherein the expansion tool further comprises a swivel.

7. The method of claim 1, further comprising expanding the reformed corrugated portion.

8. The method of claim 1, further comprising providing an aperture in at least one of the first and second uncorrugated portions.

9. The method of claim 8, further comprising surrounding the aperture with a filter medium.

10. The method claim 1, wherein the unitary structure comprises a single joint of tubular.

11. The method of claim 1, wherein the unitary structure comprises a continuous length of tubular.

12. The method of claim 1, wherein contacting the second uncorrugated portion comprises engaging the second uncorrugated portion with the expansion tool for expanding the first uncorrugated portion.

13. The method of claim 1, wherein the unitary structure comprises at least two corrugated portions.

14. The method of claim 1, further comprising:

providing a shoe at a lower portion of the unitary structure, wherein the shoe includes a seat for receiving a hydraulic isolation device;

lowering the hydraulic isolation device onto the seat of the shoe; and introducing fluid pressure into the unitary structure.

15. The method of claim 1, further comprising incrementally expanding the first uncorrugated portion using mechanical force.

16. The method of claim 15, wherein the expansion tool comprises two sets of rollers to incrementally expand the first uncorrugated portion.

17. A method of completing a well, comprising:

forming an expandable tubular, comprising:

forming a first corrugated portion; and forming a second corrugated portion, wherein the first and second corrugated portions are separated by a first uncorrugated portion;

reforming the first and second corrugated portions to a diameter greater than the first uncorrugated portion;

expanding the first uncorrugated portion using an expansion tool, wherein a second uncorrugated portion is adjacent the first uncorrugated portion; and stabilizing the expansion tool during expansion, wherein the expansion tool is stabilized by the second uncorrugated portion.

18. The method of claim 17, wherein the first and second corrugated portions are formed using a hydroforming process.

19. The method of claim 18, further comprising reforming the expandable tubular such that the first and second corrugated portions and the first uncorrugated portion have substantially the same diameter.

20. The method of claim 17, further comprising heat treating the expandable tubular.

21. The method of claim 17, further comprising expanding the second uncorrugated portion.

22. The method of claim 17, wherein the first uncorrugated portion is expanded using mechanical force.

23. The method of claim 17, further comprising sealing off fluid communication through an annular area formed between the expandable tubular and the well.

24. A method of expanding a tubular, comprising:

lowering the tubular in a wellbore, wherein the tubular includes a first corrugated portion, a second corrugated portion, and an uncorrugated portion disposed between the first and second corrugated portions;

expanding the first and second corrugated portions; and attaching a downhole tool to the uncorrugated portion after expansion of at least one of the first and second corrugated portions.

25. The method of claim 24, further comprising at least partially expanding the uncorrugated portion.

26. The method of claim 24, wherein the downhole tool includes at least one of a packer, a seal, and a casing patch.

27. The method of claim 24, wherein the tubular is a unitary structure.

28. The method of claim 24, wherein the tubular includes a second uncorrugated portion, wherein one of the first and second corrugated portions is disposed between the uncorrugated portion and the second uncorrugated portion.

29. The method of claim 28, further comprising attaching the downhole tool to the second uncorrugated portion.

30. The method of claim 24, further comprising expanding a second uncorrugated portion of the tubular using an expansion tool while contacting the uncorrugated portion.

31. The method of claim 30, further comprising stabilizing the expansion tool using the uncorrugated portion during expansion of the second uncorrugated portion.

* * * * *